US006481024B1

(12) United States Patent
Grant

(10) Patent No.: US 6,481,024 B1
(45) Date of Patent: Nov. 19, 2002

(54) PROTECTIVE CHIN STRAP FOR HELMETS

(75) Inventor: Stephen P. Grant, Long Grove, IL (US)

(73) Assignee: Athletic Specialties, Inc., Wauconda, IL (US)

( * ) Notice: Subject to any disclaimer, the term of this patent is extended or adjusted under 35 U.S.C. 154(b) by 0 days.

(21) Appl. No.: 09/580,077

(22) Filed: May 30, 2000

(51) Int. Cl.[7] ..... A41D 13/00; A42B 3/08
(52) U.S. Cl. ..... 2/421; 2/9; 2/425
(58) Field of Search ..... 2/421, 424, 425, 2/410, 411, 412, 414, 9

(56) References Cited

U.S. PATENT DOCUMENTS

| | | | | |
|---|---|---|---|---|
| 1,262,818 A | | 4/1918 | McGill | |
| 2,250,275 A | | 7/1941 | Riddell | |
| 2,867,811 A | | 1/1959 | Jones | |
| 2,898,596 A | * | 8/1959 | Keen | 2/9 |
| 3,187,342 A | | 6/1965 | Aileo | |
| 3,216,023 A | * | 11/1965 | Morgan | 2/421 |
| 3,327,316 A | | 6/1967 | Pukish, Jr. | |
| 3,619,813 A | | 11/1971 | Marchello | |
| 3,787,895 A | | 1/1974 | Belvedere | |
| 3,916,446 A | | 11/1975 | Gooding | |
| 4,044,400 A | | 8/1977 | Lewicki et al. | |
| 4,461,044 A | | 7/1984 | Reiterman et al. | |
| 4,646,368 A | | 3/1987 | Infusino et al. | |
| 4,651,356 A | | 3/1987 | Zide | |
| 4,741,054 A | | 5/1988 | Mattes | |
| 4,829,599 A | | 5/1989 | Giorgio et al. | |
| 5,347,660 A | * | 9/1994 | Zide et al. | 2/421 |
| 5,794,274 A | | 8/1998 | Kraemer | |
| 6,298,483 B1 | * | 10/2001 | Schiebl et al. | 2/9 |

FOREIGN PATENT DOCUMENTS

DE 19642572 4/1997

OTHER PUBLICATIONS

Excepts from Athletic Specialities, Inc. "The Coach's Best Friend" catalog. Athletic Specialities, Inc., 240 Industrial Dr., Wauconda, Il 60084. p. 14. Date: Document is undated, but chin straps shown on p. 14 were commercially available prior to May 30, 1998.

Excerpts from Adams USA "Trace" catalog. Adams USA, Inc./Neumann Glove, P.O. Box 489, 610 S. Jefferson, Cookeville, TN 38501. pp. 64, 65. Date: Document is undated, but chin straps shown on pp. 64 and 65 were commercially available prior to May 30, 1998.

Excerpts from Schutt Sports "The Gear That Makes The Game. A Century of Innovation." catalog. Schutt Sports, P.O. Box 426 Litchfield, IL 62056–0426. p. 13. Date: Document is dated Aug. 1999, but the chin straps on p. 13 were commercially available prior May 30, 1998.

Excerpts from Nokona Athletic Goods Company "1999–2000 Football Equipment Catalog." Nokona Athletic Goods Company, 208 Walnut Street, P.O. Box 329, Nokona, TX 76255. p. 5. Date: Document is dated 1999, but the chin straps shown on p. 5 were commercially available prior to May 30, 1998.

* cited by examiner

*Primary Examiner*—Peter Nerbun
(74) *Attorney, Agent, or Firm*—Jansson, Shupe & Munger, Ltd.

(57) ABSTRACT

A protective chin strap device for use in securing a helmet to a wearer's head. The chin strap includes a hard outer shell, an inner member made of a self-supporting cushioned material and straps attached to the outer shell for securing the chin strap to a helmet. The inner member is secured with respect to the outer shell so as to contact the outer shell adjacent the wearer's chin yet form at least one cavity between the outer shell and inner member. This combination of elements serve to deflect impact forces applied to the chin strap and further serve to absorb and laterally dissipate those impact forces. The chin strap is comfortable to wear because the wearer's chin is cushioned by the inner member, because a soft liner is provided adjacent the wearer's skin to wick perspiration and moisture from the wearer's chin and because the chin strap is ventilated.

25 Claims, 5 Drawing Sheets

PROTECTIVE CHIN STRAP FOR HELMETS

FIELD OF THE INVENTION

This invention is related generally to headgear securing devices and more specifically, to protective securing devices for use with athletic and other types of helmets.

BACKGROUND OF THE INVENTION

Helmets are commonly used in athletic events and other physical activities in which it is desirable to protect persons from head injuries. Head injuries can be sustained in these activities as a result of impact forces incident to contact with other persons and objects. A potentially vulnerable region of the head is the chin and jaw area which can project below or outside of the helmet and, therefore, be exposed to injury from impact forces. Athletes, such as football players, as well as members of the military, fire fighters and others are typical of the types of persons for whom it is desirable to provide a measure of head and chin protection.

Helmets used in the abovementioned types of activities are typically secured to the wearer's head by use of a chin strap. Conventional chin straps usually consist of a cup-like strap which is fitted to the wearer's chin and two or more straps which secure the chin strap to the helmet. The straps typically extend outwardly from opposite ends of the chin strap cup and are secured to the lower portion of the helmet by snaps. The straps are adjusted to snugly secure the helmet to the wearer's head.

Conventional chin straps are constructed in a variety of different configurations. Certain chin straps are made of flexible webbing and are used solely to secure the helmet to the wearer's head. Other types of chin straps incorporate rigid or semi-rigid shells in combination with a chin cup in an effort to provide some measure of protection against impact forces applied to the wearer's chin.

All of these conventional chin straps have one or more shortcomings with respect to the protection they provide for the wearer. For example, chin straps with chin strap cups made only of flexible webbing are not effective in providing protection against impact forces applied to the wearer's chin. As can be readily understood, the force of a blow to the chin is transferred directly through the webbing to the wearer.

Even chin straps which include a rigid or semi-rigid outer shell can be ineffective in protecting a wearer's chin. These chin straps typically include an inner liner made of a foam material which is glued directly to the inner surface of a hard outer shell. This arrangement provides some dissipation of impact forces but continues to permit those forces to be directly transferred to the wearer's chin because the outer shell and liner are positioned directly against each other.

The chin strap of U.S. Pat. No. 5,794,274 (Kraemer) attempts to solve some of these force-dissipation problems by providing a chin strap which consists of a rigid outer shell in combination with a chin cup made of a flexible webbing. The webbing must be suspended from the outer shell due to its flexibility and lack of rigidity. The outer shell and chin cup are separated in the area directly adjacent to the wearer's chin. The patent explains that this is done so that impact forces are directed to the ends of the chin strap and away from the wearer's chin.

However, because flexible webbing is used for the chin cup, rather than a soft foam-type material, the chin strap device of this patent may permit the chin to directly strike the outer shell in the event of a severe impact. In addition, the chin strap device of the patent requires many parts and assembly is unduly complicated. For instance, one example shown in the patent requires the use of "rim covers" glued over the flexible web and outer shell as a means of suspending the flexible web with respect to the outer shell. These rim covers appear to be unduly difficult to position relative to the webbing and outer shell and may be prone to failure upon impact causing the flexible webbing to collapse into the outer shell.

The Nokona Model CSC 100 chin strap available from Nokona Sporting Goods, Nokona, Texas is another example of a chin strap which attempts to solve this force-dissipation problem by providing a space between an inner chin cup and an outer shell. The Model CSC 100 chin strap has a rigid, grille-like outer shell and a foam inner chin cup loosely attached to the outer shell by a pair of straps. The inner chin cup is easily moveable and is very soft and pliable. The inner chin cup can easily contact the inner surface of the outer shell thereby permitting impact forces to be directly transferred from the outer shell to the inner chin cup. In addition, the inner chin cup can easily be pushed away from the edges of the outer shell potentially allowing the hard upper and lower edges of the outer shell to come directly into contact with the wearer's face. Moreover, the openings in the grille-like structure of the outer shell are sufficiently spaced apart to permit an opposing player to grab hold of the chin strap possibly causing removal of the chin strap and loss of the wearer's helmet.

Yet additional shortcomings of certain conventional chin straps stem from the design of the rigid outer shell. In these chin straps, the straps are riveted directly to the outer shell. The rivet can then protrude through the inner chin cup and toward the wearer's chin permitting an impact force to be directly transferred through the rivet to the wearer. The chin strap of U.S. Pat. No. 5,794,274 is such a device.

In addition, the upper and lower edge surfaces of certain conventional rigid outer shells are not recessed away from the wearer's chin and can potentially injure the wearer. Even if a foam chin cup is provided, these upper and lower outer shell edges are close enough to the wearer's chin so that they can be driven into the wearer's face upon receiving a severe impact force. The Nokona Model CSC 100 chin strap is such a chin strap, particularly given that the inner chin cup can easily be pushed away from the outer shell exposing the edges of the outer shell to the wearer's chin.

Other problems with conventional chin straps stem from the fact that the protective components of the chin strap can cause discomfort to the wearer. For example, the foam material of conventional chin strap cups is designed to be positioned directly against the wearer's chin. Such an arrangement can be less than satisfactory because the foam retains body heat and limits the passage of air thereby impairing cooling and ventilation of the wearer's chin. Upon physical exertion, the wearer's chin becomes hot and moist with perspiration. Heat build up is a particular problem when the helmet and chin strap are worn on hot days. The retention of body heat is not only uncomfortable for the wearer but can cause heat-related rashes. In addition, the accumulation of moisture from perspiration present in the chin strap can cause the chin strap to slide off the wearer's chin resulting in failure of the chin strap system and loss of the wearer's helmet.

It would be a significant improvement in the art to provide an improved protective chin strap which would deflect, dissipate and generally lessen impact forces to the wearer's chin and head, which would be comfortable to wear even on hot days and which would be sturdy and economical to manufacture.

OBJECTS OF THE INVENTION

It is an object of this invention to provide an improved chin strap overcoming problems and shortcomings of the prior art.

Another object of this invention is to provide an improved chin strap which provides protection for the user.

An additional object of this invention is to provide an improved chin strap which laterally dissipates force applied to the chin strap.

It is also an object of this invention to provide an improved chin strap which absorbs force applied to the chin strap.

A further object of this invention is to provide an improved chin strap which is designed so that strap fasteners and other protrusions are not in contact with the wearer.

Yet another object is to provide an improved chin strap which is designed so that edges of the protective outer shell are not in contact with the wearer.

Still another object of the invention is to provide an improved chin strap which is designed so that edges of the protective outer shell do not come into contact with the wearer in case of chin strap "slip off."

It is also an object of this invention to provide an improved chin strap which is designed so that the inner padding adjacent the wearer's chin can be sized to fit the wearer.

One additional object of this invention is to provide an improved chin strap which remains in place on the wearer's chin.

Another object of this invention is to provide an improved chin strap which includes a comfortable surface directly adjacent the wearer's chin.

An additional object of this invention is to provide an improved chin strap which wicks moisture and perspiration from the wearer's chin.

A further object of this invention is to provide an improved chin strap which is ventilated thereby keeping the wearer cooler and more comfortable.

Yet another object of this invention is to provide an improved chin strap which is sturdy and economical to manufacture and assemble.

How these and other objects are accomplished will be apparent from the descriptions of this invention which follow.

SUMMARY OF THE INVENTION

Figure 1:
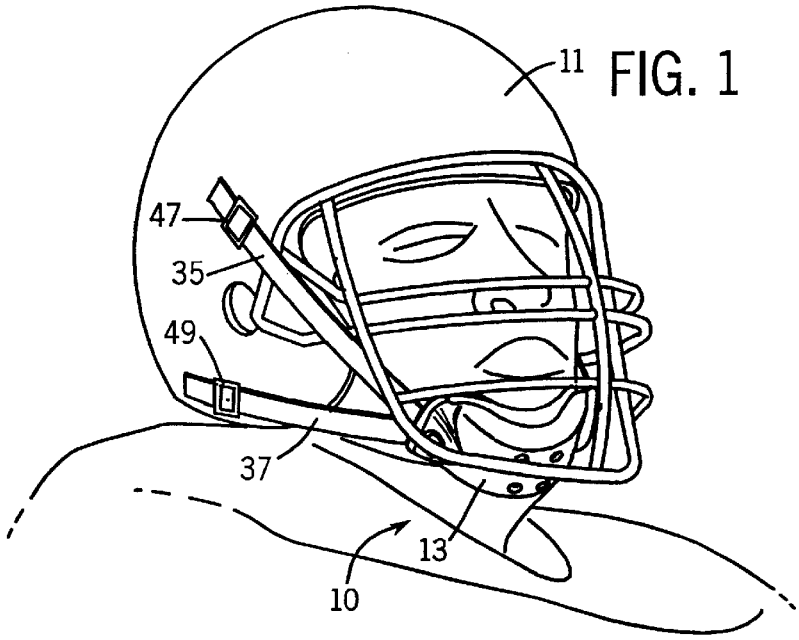
FIG. 1 is a perspective view of an exemplary chin strap used in conjunction with a football helmet.

The present invention is an improved chin strap for use with helmets, such as helmets used in athletics, the military, industry and elsewhere. In general, the chin strap includes a hard outer shell conformed to fit a wearer's chin, at least a pair of straps secured to the outer shell for attaching the chin strap to a helmet and an inner member also conformed to fit the wearer's chin. The inner member is made of a material which is soft yet has sufficiently thickness and rigidity to be self-supporting without the need to be suspended from another object, such as the outer shell. The inner member is preferably nested within at least a portion of the outer shell so as to form at least one cavity between the outer shell and inner member substantially adjacent a chin-receiving pocket positioned in the inner member. The combination of the outer shell and the partially-spaced apart inner member serve to deflect and cushion the force of impacts applied to the chin strap.

Preferred embodiments of the outer shell include an outer surface, a substantially concave inner surface and first and second ends. The outer shell outer surface is shaped to aid in deflecting impact forces applied to the outer shell and is preferably substantially convex. Acrylonitrile butadiene styrene (ABS) plastic, polycarbonate and polystyrene are examples of suitable materials for use in making the outer shell. It is further preferred that the outer shell include a strap-receiving cavity formed in the outer shell inner surface along each of the first and second ends. It is preferred that the straps are attached to the inner surface of each strap-receiving cavity and that the strap or straps extend away from the outer shell. The straps are preferably attached suitable attachment means, such as rivets.

Preferred embodiments of the inner member include an outer surface and an inner surface. The inner surface is preferably a substantially concave surface and includes a chin-receiving pocket. The inner member outer surface may be substantially convex in shape. The inner member and outer shell are preferably preformed components. Cross-linked polyethylene foam and urethane foam are examples materials potentially useful in making the inner member.

It is highly preferred that the inner member further include at least one shock-absorbing member attached to and extending away from the inner member outer surface and toward the outer shell inner surface. This member acts as an additional shock absorbing element, deforming and absorbing energy when extreme impact forces are applied to the chin strap. The shock absorbing member is preferably positioned in the cavity between the inner member and outer shell and may be integral with the inner member. The member may be of any suitable design such as an "x-shaped" pattern or even a low-density foam material which fills all or a portion of the cavity between the inner member and outer shell. The shock absorbing member may be in contact with the outer shell inner surface and may be attached to a portion of such surface by means of a suitable connector, such as an adhesive, velcro, etc. In this arrangement, there is no single cavity between the entire outer shell inner surface and inner member, but, rather, a plurality of cavities.

The inner member and outer shell collectively absorb and dissipate impact forces. The hard outer shell deflects impact forces. The foam material of the inner member and preferred projecting portion act to cushion the chin and absorb impact forces. The at least one cavity formed between the inner member and outer shell cause impact forces to be laterally dissipated to the ends of the chin strap preventing the forces from being directly transferred to the wearer's chin.

Preferred forms of the outer shell may include further protective structure, for example to minimize the possibility that impact forces may be transferred to the wearer through the strap fasteners. To accomplish this objective, each strap-receiving cavity preferably comprises a protrusion formed in the outer shell outer surface. It is preferred that the inner member and outer shell are secured with respect to the other so as to form a void volume or space between each outer shell cavity and the inner member so that each strap may extend outwardly between the outer shell and inner member.

Each strap preferably has a first end attached directly to the outer shell. Preferably, each strap is attached to its respective cavity inner surface. Most preferably, each strap is attached by means of a rivet. This advantageous arrangement has the effect of positioning the fastener at a location recessed away from the wearer's chin thereby minimizing the likelihood that an impact force would be transferred through the fastener to the wearer's chin.

Another protective feature in highly preferred embodiments of the chin strap is that the upper and lower edges of the outer shell are designed to be out of contact with the user thereby minimizing the possibility that the upper and lower edges of the outer shell could contact and injure the wearer's chin in the event of an extreme impact force. Preferably, the upper and lower edges of the outer shell are formed or recessed to be away from the chin thereby positioning those edges away from the wearer's chin. In addition, the inner member may be provided with upper and lower barrier portions and these portions may include surfaces which abut their respective outer shell upper and lower recessed edges in a coextensive manner thereby forming a cushioned barrier between the outer shell recessed edges and the wearer's chin. The upper and lower inner member barrier portions may also protrude above and below their respective outer shell upper and lower recessed edges to provide further protection for the wearer.

A further preferred feature of the chin strap is that the outer shell may include one or more openings so that air may pass between the outer shell and inner member providing ventilation for the chin. Preferably, the inner member also includes at least one perforation to allow air to pass between the wearer's chin and the inner member further enhancing ventilation.

It is highly preferred that a soft, moisture-absorbing liner is provided for contact with the wearer's chin and that the liner is attached along substantially all of the inner member chin-receiving pocket. Most preferably, the liner is attached along substantially all of the inner member inner surface.

The chin-receiving pocket provided in preferred versions of the chin strap is preferably formed by opposed top and bottom and side walls. The arrangement of these walls permits the inner member and chin-receiving pocket to be sized to fit the chin of a particular user. Since the inner member outer surface need not be adjusted to fit the size of a particular user, one size of outer shell can be used thereby minimizing manufacturing cost.

The novel chin strap is further advantageous because it requires few parts. The few parts which are required may be manufactured using conventional technology and can be easily assembled. The parts are designed for rapid and easy assembly. For example, the nested design of the preferred inner member and outer shell allows these pieces to be easily joined together.

It should be pointed out that, while the present invention represents an improvement in the chin strap art, neither this device, nor any other device, can remove the risk of injury to the head, neck and chin for those who participate in inherently hazardous activities such as football and the like. Further, no helmet or other protective device can prevent the risk of injury when those devices are used in a manner contrary to the rules of the sport or other endeavor, for example to spear or ram an opposing player, person or object. Helmets and chin straps must always be used in an appropriate manner and in accordance with all rules and guidelines.

DETAILED DESCRIPTION

Examples of the invention are shown in FIGS. 1–8. The examples shown in these figures and described herein are intended to be illustrative only and not limiting with respect to the scope of the invention.

FIG. 1 shows an exemplary chin strap 10 in use with helmet 11 which is a helmet of a type used to play the sport of football. The inventive chin strap 10 is not limited to use with football helmets 11 and can be used to secure any helmet where chin protection is desired. For example, chin strap 10 may be used with a helmet used by members of the military (not shown).

Figure 2:
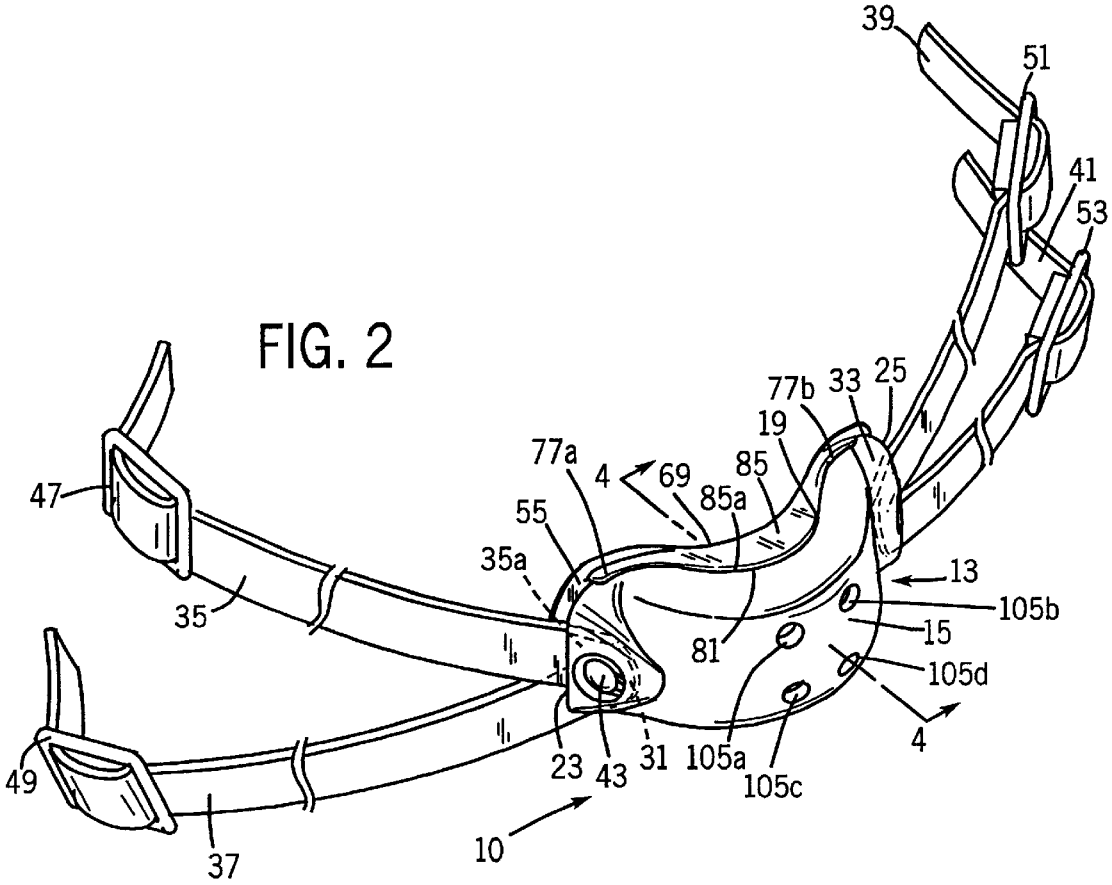
FIG. 2 is a perspective view of an exemplary chin strap.
Figure 3:
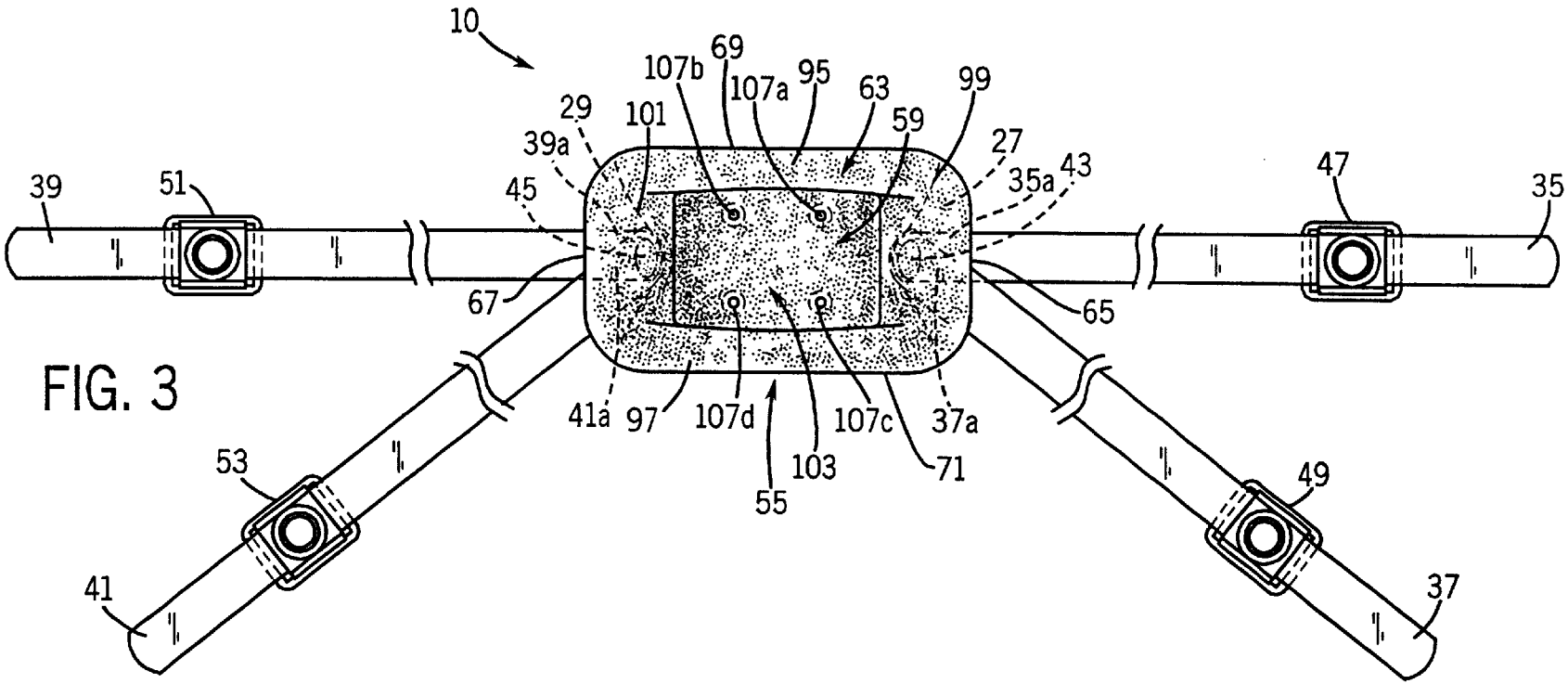
FIG. 3 is a perspective view of an exemplary chin strap.

FIGS. 2 and 3 show partial perspective views of the chin strap 10 of FIG. 1. FIG. 2 shows the chin strap 10 from a side facing the outer shell 13. FIG. 3 shows the chin strap from the opposite side, facing inner member 55.

Figure 4:
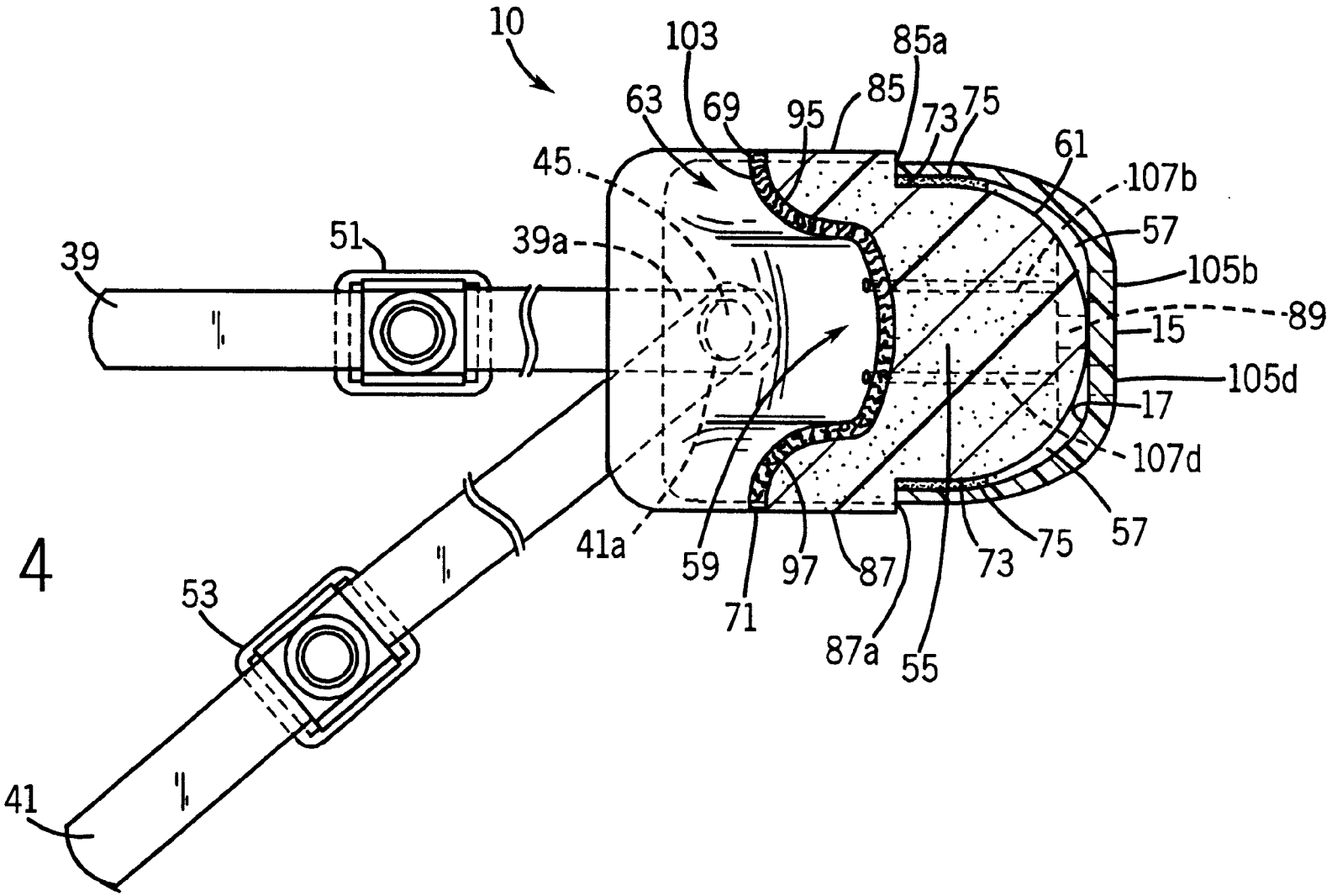
FIG. 4 is a cross-sectional view of the exemplary chin strap of FIG. 2 taken along line 4—4 of FIG. 2.
Figure 8:
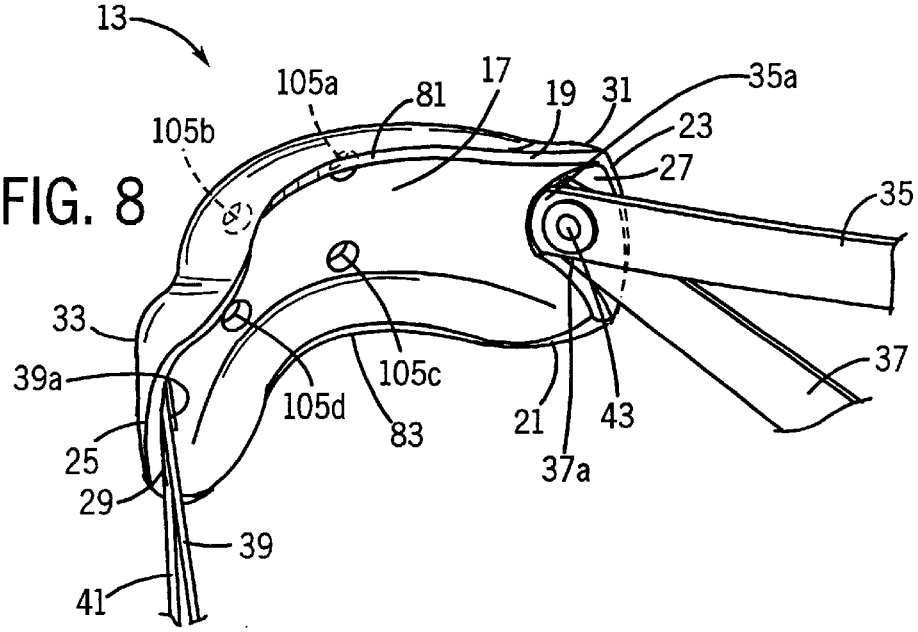
FIG. 8 is a perspective view of an exemplary chin strap outer shell.

A preferred embodiment of outer shell 13 is shown particularly in FIGS. 2, 4 and 8. Outer shell 13 is provided for the purpose of absorbing and deflecting impact forces such as the force applied by a blow to the chin from an opposing football player. Outer shell 13 is preferably made of a hard material such as ABS plastic because of its ease of manufacture and low cost. However, any rigid or semi-rigid material with sufficient hardness may be used.

The exemplary outer shell 13 shown in FIGS. 1–2, 4 and 8 is conformed to fit a wearer's chin and includes an outer surface 15, a substantially concave inner surface 17, upper 19 and lower 21 edge surfaces defining the upper and lower ends of outer shell 13 and first 23 and second 25 ends. The substantially convex shape of outer surface 15 shown is a highly preferred shape because it conforms to the shape of a wearer's chin. A strap-receiving cavity 27 is formed in first end 23 and another strap-receiving cavity 29 is formed in second end 25. Cavities 27 and 29 may be provided along inner surface 17 by any suitable manner, such as by forming shell 13 to include cavities 27 and 29 and corresponding shell protruding portions 31 and 33 as particularly shown in FIGS. 2 and 8.

Straps 35, 37, 39 and 41 are provided to secure chin strap 10 to helmet 11. Any number of straps may be used and the straps may be made of any suitable material. Straps 35–41 are preferably made of spun polyester or nylon webbing encased in an outer coating of polyvinyl chloride (PVC) or urethane.

Each strap 35–41 has a respective first end 35*a*–41*a* which is attached to inner surface 17 along a respective cavity 27 or 29 by a suitable connector, such as rivets 43 and 45. Straps 35–41 extend away from shell 13 through respective cavity 27 or 29. Inner surface 17 along cavities 27 and 29 is sufficiently spaced apart from inner member 55 so that rivets 43 and 45 and straps 35–41 do not create protrusions in inner member inner surface 63 against the wearer's chin. This novel arrangement minimizes the possibility that impact forces could be transferred directly to the wearer through rivets 43, 45 or straps 35–41. The void volume of cavities 27 and 29 and the spacing of inner surface 17 along such cavities from inner member 55 can be modified as needed to accommodate, for example, the type of strap fastener selected, the type of material used for inner member 55 and the type of material used for straps 35–41.

As shown in FIGS. 1 and 2–4, straps 35–41 are secured to helmet 11 by female snaps 47, 49, 51 and 53 on respective straps 35–41 and corresponding male snaps (not shown) on helmet 11. While snaps have been shown, any suitable connector system may be used to secure chin strap 10 to helmet 11.

Preferred embodiments of inner member 55 are shown particularly in FIGS. 2–7A. Preferred inner member 55 is provided to nest comfortably against the wearer's chin and to absorb impact forces applied to chin strap 10. Inner member 55 dissipates and absorbs force by flexing toward outer shell 13 when a force is applied to chin strap 10 thereby absorbing energy and dissipating energy toward outer shell ends 23, 25 and away from the wearer's chin.

In the preferred embodiment shown, inner member 55 is a one-piece member conformed to fit the wearer's chin and is made of a foam material having a thickness sufficient to flex and compress thereby absorbing impact forces applied to chin strap 10. Preferably inner member 55 is made of a material which is resilient and regains its shape after flexure or compression. Inner member 55 is also preferably made of a material which is sufficiently soft so as to be comfortable for the wearer yet is sufficiently rigid to be self-supporting without the need to be suspended from outer shell 13. Use of a self-supporting material for inner member 55, rather than a fabric strip-like web, is advantageous because it avoids collapse of inner member 55 in the event force is applied to chin strap 10 and makes the chin strap easier to manufacture and assemble. A preferred material for use in making inner member 55 is cross-linked polyethylene foam, but any suitable material may be used.

Inner member 55 is shown nested within at least a portion of outer shell 13. Inner member 55 is secured within at least a portion of the outer shell inner surface 17 so as to form at least one cavity 57 between outer shell 13 and inner member 55 substantially adjacent chin-receiving pocket 59.

As best shown in FIGS. 3–7 the preferred inner member 55 has an outer surface 61, inner surface 63, first 65 and second 67 ends, upper 69 and lower 71 edge surfaces defining the upper and lower ends of inner member 55 and chin-receiving pocket 59. The substantially convex shape of outer surface 61 and substantially concave shape of inner surface 63 are preferred because they conform to the shape of the wearer's chin. It is envisioned that other suitable shapes could be used.

Inner member 55 abuts inner surface 17 of outer shell 13 along inner member abutment surface 73 which is provided about the periphery of inner member outer surface 61. Inner member 55 is preferably secured to outer shell 13 with an adhesive 75 applied along abutment surface 73. This advantageous arrangement permits inner member 55 and outer shell 13 to be securely and easily joined yet at the same time positions adhesive 75 away from inner member upper and lower edges 69, 71 and, accordingly, away from potential contact with the wearer's chin and mouth. Other suitable attachment means, such as velcro, stitching and frictional members, may be used to join outer shell 13 to inner member 55.

As shown in FIGS. 2 and 5–7, inner member 55 may also include upper stop members 77*a* and 77*b* and/or corresponding lower stop members 79*a* and 79*b* which may abut and protrude over outer shell upper and lower edges 19 and 21 to more securely position inner member 55 with respect to respective outer shell 13. If adhesive 75 is used to join outer shell 13 and inner member 55, stop members 77*a*, 77*b*, 79*a* and 79*b* further serve as barriers to prevent adhesive 75 from being .positioned anywhere near inner member upper and lower edges 69, 71 thereby further avoiding any possibility that adhesive 75 could come into contact with the wearer's chin and mouth.

As best shown in FIGS. 2 and 8, outer shell upper and lower edges 19 and 21 may include respective upper and lower recessed portions 81 and 83. The purpose of recessed portions 81 and 83 is to position the relatively hard outer shell upper and lower edges 19 and 21 away from the wearer's chin to thereby minimize the possibility that such edges 19, 21 could come into contact with the wearer's chin.

Figure 6:
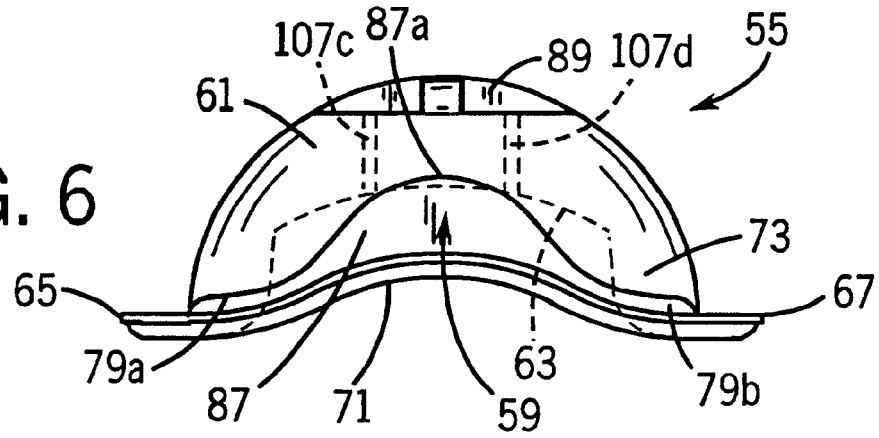
FIG. 6 is a further perspective view of the exemplary chin strap inner member of Figure viewed from beneath the inner member.
Figure 7:
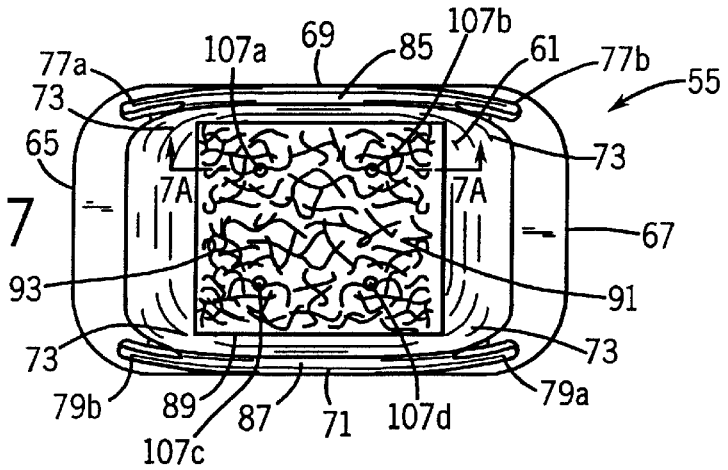
FIG. 7 is a perspective view of another exemplary chin strap inner member.
Figure 7A:
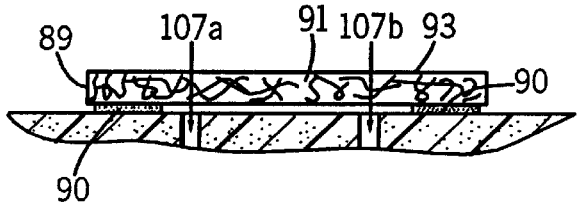
FIG. 7A is a cross-sectional view of the exemplary chin strap inner member of FIG. 7 taken along line 7A—7A of FIG. 7.

FIGS. 2, 4 and 6 show optional inner member upper 85 and lower 87 barrier portions preferably provided in inner member 55 to respectively protrude above and below outer shell upper and lower edges 19, 21 to form a cushioned barrier between some or all of outer shell upper and lower edges 19 and 21 and the wearer's chin. Upper and lower barrier portions 85, 87 abut respective upper and lower edges 19, 21 along abutment surfaces 85*a* and 87*a*. Barrier portions 85 and 87 are preferably coextensive with all or some of respective recessed outer shell recessed portions 81 and 83 and respective outer shell edges 19 and 21. Barrier portions 85 and 87 further serve to prevent any adhesive 75 from being positioned anywhere near inner member upper and lower edges 69 and 71.

Figure 5:
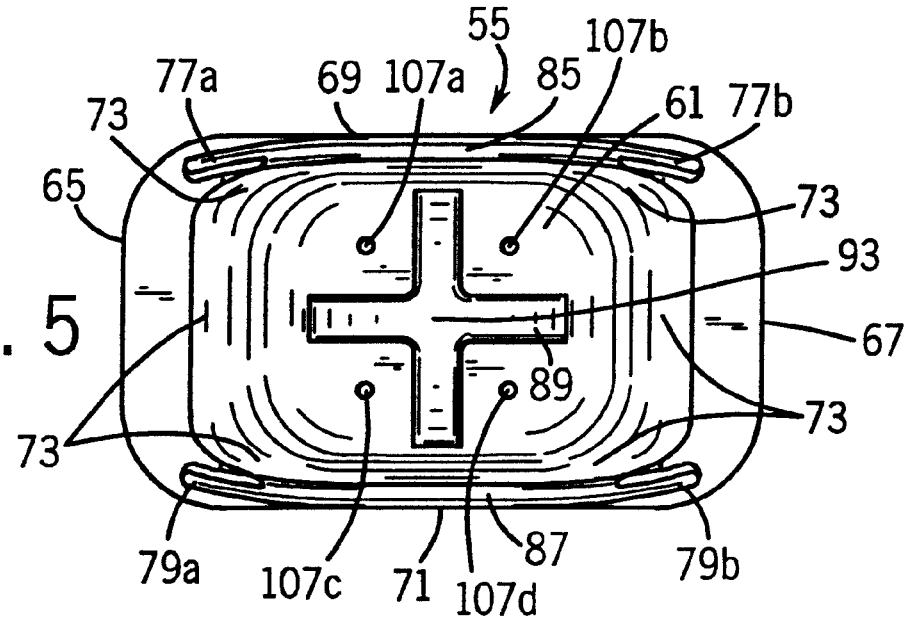
FIG. 5 is a perspective view of an exemplary chin strap inner member.

Inner member 55 includes at least one shock absorbing member 89 attached to and extending away from inner member outer surface 61 and toward outer shell inner surface 17 for engaging outer shell inner surface 17 and absorbing force applied to chin strap 10. Member 89 is compressed and absorbs energy as inner member 55 flexes toward outer shell 13 as force is applied to chin strap 10. Member 89 shown in FIGS. 4–6 is a raised portion formed in inner member outer surface 61 and is integral with inner member 55. Member 89 abuts outer shell inner surfacer 7 along some or all of shock absorbing member abutment surface 91. Preferably member 89 is resilient and regains its shape after compression.

Shock absorbing member 89 is shown as being formed in inner member 55 but row could be secured to inner member outer surface 61 in other ways, such as by adhesive (not shown), to inner member outer surface 61. Member 89 may be of any suitable design such as the "x-shaped" pattern shown in FIGS. 4–6 or even a plurality or projecting members such as cylindrically-shaped projections (not shown). In the alternative embodiment shown in FIGS. 7 and 7A, member 89 comprises a material with a density lower than that of inner member 55. Suitable low-density materials for use in this alternative embodiment include polyolefin foam. Member 89 shown in FIGS. 7 and 7A may be either integral with or attached to inner member 55 along outer surface 61 with adhesive 90. Member 89 of FIG. 7 has many small void volumes 91 formed in it in effect dividing cavity 57 into many small cavities. In this embodiment, member 89 fully or substantially fills cavity 57 yet, because of the void volumes between inner member 55 and outer shell inner surface 17, permits inner member 55 to flex toward outer shell inner surface 17 upon application of force to the chin strap.

As best shown in FIGS. 4–7A, shock absorbing member 89 has surface 93 which is in contact with outer shell inner surface 17. In these embodiments, cavity 57 actually consists of separate cells formed between the outer shell inner surface 17 and inner member outer surface 61. If desired, surface 93 could be attached to a portion of inner surface 17 by means of a suitable connector, such as an adhesive, velcro, etc. applied along some or all of surface 93.

FIG. 3 and 4 show chin-receiving pocket 59 formed in inner surface 63 by opposed top 95 and bottom 97 and opposed side walls 99, 101. Pocket 59 may be made to fit the chin of any size person from a youth to an adult by varying the size and shape of walls 95–101. Advantageously, inner member outer surface 61 can remain a single size and shape irrespective of the size of pocket 59 thereby permitting a single outer shell 13 configuration to be customized to the size of different persons. This feature reduces manufacturing costs and simplifies assembly.

As shown particularly in FIG. 3, inner member 55 includes an optional liner 103 provided along substantially all of chin-receiving pocket 59 and preferably along substantially all of inner surface 63. Liner 103 is made of a soft material which wicks moisture, such as perspiration, from the wearer's chin. By keeping the chin dry, rashes are avoided and the chance of chin strap slippage is reduced. Suitable liner materials include, without limitation, nylon, polyester and polypropylene. The exemplary liner 103 shown in FIG. 3 is attached directly to inner surface 63 by appropriate means, such as by a flame lamination process in which the liner material is attached to near-molten foam material used for inner member 55. The flame lamination process is advantageous because no glue-type adhesive is required to bond the liner 103 to the inner member 55.

It is also desirable to provide structure for ventilation of chin strap 10 so as to make chin strap 10 cooler and more comfortable to wear, particularly when used on hot days. Accordingly, one or more openings 105*a*–105*d* may be provided in outer shell 13 to allow air to pass between outer shell 13 and at least one cavity 57. One or more openings 107*a*–107*d* may also be provided in inner member 55 to allow air to pass between the wearer's chin and inner member 55. All of such ventilation openings in outer shell 13 and inner member 55 may be of any suitable size, shape and number.

In use, the novel chin strap 10 absorbs, dissipates and generally lessens impact forces applied to chin strap 10 while at the same time enhancing the comfort of the chin strap 10 to the wearer. Impact forces applied to chin strap 10 are absorbed by outer shell 13 and inner member 55. Outer shell 13 also deflects impact forces. The inner member 55 flexes and absorbs force as the wearer's chin moves toward the outer shell 13. Impact forces may be further dissipated by member 89 which compresses against outer member inner surface 17 to further absorb force in the event of a force applied to the chin strap 10.

In addition, force is dissipated laterally and away from the wearer's chin by the arrangement of the inner member 55 and outer shell 13 and the at least one cavity 57 formed therebetween or by the use of a low density foam material 89 having void volumes 91 to partially fill cavity 57. Forces are dissipated laterally toward ends 23 and 25 of chin strap 10 rather than directly toward the wearer's chin as inner member 55 flexes toward outer shell 13 thereby reducing the chance of injury to the wearer.

The chin strap 10 is comfortable because the wearer's chin is cushioned by inner member 55 which may include a chin-receiving pocket 59 sized to fit the wearer. The soft liner 101 wicks moisture from the wearer's chin and openings 105*a*–105*d*, 107*a*–107*d* optionally provided in outer shell 13 and inner member 55 respectively ventilate and cool chin strap 10.

While the principles of this invention have been described in connection with specific embodiments, it should be understood clearly that these descriptions are made only by way of example and are not intended to limit the scope of the invention.

What is claimed:

1. A chin strap for use with a helmet comprising:

a hard outer shell conformed to fit a wearer's chin comprising an outer surface, a substantially concave inner surface and first and second ends;

straps for securing the chin strap to the helmet, each strap having a first end attached to a respective one of the shell ends and a second end away from the shell; and a self-supporting inner cushion member conformed to fit the wearer's chin and made of a material having a predetermined thickness sufficient to absorb impact forces thereon, the inner member having an outer surface and a substantially concave inner surface including a chin-receiving pocket, the inner member being secured independent of the straps in a fixed-position relationship within at least a portion of the outer shell inner surface to form at least one cavity between the outer shell and inner member substantially adjacent the chin-receiving pocket.

2. The chin strap of claim 1 wherein the outer shell outer surface is substantially convex.

3. The chin strap of claim 1 wherein the outer shell further includes a strap-receiving cavity provided in the outer shell inner surface along each of the first and second ends.

4. The chin strap of claim 3 wherein each strap-receiving cavity comprises a protrusion formed in the outer shell outer surface.

5. The chin strap of claim 3 wherein each strap-receiving cavity comprises a void defined by the inner member and the outer shell inner surface and each strap extends outwardly through the respective strap-receiving cavity between the outer shell and inner member.

6. The chin strap of claim 3 wherein the first end of each strap is attached directly to the outer shell inner surface within the strap-receiving cavity by a connector.

7. The chin strap of claim 6 wherein the connector is a rivet.

8. The chin strap of claim 1 further including:

upper and lower edges in the outer shell;

an upper and lower recessed portion in the respective upper and lower outer shell edge;

upper and lower barrier portions formed in the inner member, said barrier portions each having a surface substantially coextensive with and abutting at least the respective upper or lower outer shell recessed portion.

9. The chin strap of claim 8 wherein the inner member upper barrier portion protrudes above the outer shell upper edge and the inner member lower barrier portion protrudes below the outer shell lower edge.

10. The chin strap of claim 1 wherein the outer shell includes at least one opening to allow air to pass between the outer shell and at least one cavity.

11. The chin strap of claim 1 wherein the inner member further includes at least one shock absorbing member attached to and extending away from the inner member outer surface and toward the outer shell inner surface, said shock absorbing member engaging the outer shell inner surface and absorbing force applied to the outer shell.

12. The chin strap of claim 11 wherein the shock absorbing member is a low density foam having a plurality of void volumes.

13. The chin strap of claim 1 wherein the inner member further includes a liner attached along substantially all of the chin-receiving pocket.

14. The chin strap of claim 13 wherein the liner is attached to substantially all of the inner member inner surface.

15. The chin strap of claim 1 wherein the chin-receiving pocket is formed by opposed top and bottom and side walls.

16. The chin strap of claim 1 wherein the inner member includes at least one opening to allow air to pass between the wearer's chin and the inner member.

17. A chin strap for use with a helmet comprising:

a hard outer shell conformed to fit a wearer's chin comprising an outer surface, a substantially concave inner surface and first and second ends, the outer shell further including upper and lower recessed edge portions formed in the outer shell;

at least one strap attached along each end of the outer shell and extending away from the outer shell for securing the chin strap to the helmet; and a self-supporting inner cushion member conformed to fit the wearer's chin, the inner member being made of a material having a predetermined thickness sufficient to absorb impact forces thereon, the inner member further having an outer surface, a substantially concave inner surface and upper and lower edges, the inner member being secured within at least a portion of the outer shell, the inner member also having upper and lower barrier portions formed therein each barrier portion comprising a cushion defined by a barrier portion edge coextensive with and abutting a respective upper or lower outer shell recessed edge portion and a respective upper or lower inner member edge, said upper barrier portion protruding above the outer shell upper recessed edge portion and said inner member lower barrier portion protruding below the outer shell lower recessed edge portion.

18. The chin strap of claim 17 wherein the inner member further includes a liner attached along substantially all of the inner surface.

19. A chin strap for use with a helmet comprising:

a hard outer shell conformed to fit a wearer's chin comprising an outer surface, a substantially concave inner surface, first and second ends and a strap-receiving cavity formed in the outer shell inner surface along each of the first and second ends;

straps for securing the chin strap to the helmet, each strap having a first end attached to a respective one of the shell ends in a respective strap-receiving cavity, a strap portion extending away from the first end through the strap-receiving cavity and a second end away from the shell; and a self-supporting inner cushion member conformed to fit the wearer's chin and made of a material having a predetermined thickness sufficient to absorb impact forces thereon, the inner member having an outer surface and a substantially concave inner surface, the inner member being secured independent of the straps in a fixed-position relationship within at least a portion of the outer shell inner surface.

20. The chin strap of claim 19 wherein each strap-receiving cavity comprises a protrusion formed in the outer shell outer surface.

21. The chin strap of claim 20 wherein each strap-receiving cavity comprises a void defined by the inner member and the outer shell inner surface and each strap extends outwardly through the respective strap-receiving cavity between the outer shell and inner member.

22. The chin strap of claim 19 wherein the inner member further includes a liner attached along substantially all of the inner surface.

23. The chin strap of claim 1 wherein there are two of said straps attached at each end of the shell.

24. The chin strap of claim 19 wherein there are two of said straps attached at each end of the shell.

25. The chin strap of claim 17 wherein the outer shell upper and lower recessed edge portions each include a non-flanged edge and each inner member barrier portion edge abuts the respective upper or lower outer shell recessed edge portion along substantially all of the non-flanged edge.

* * * * *

UNITED STATES PATENT AND TRADEMARK OFFICE

CERTIFICATE OF CORRECTION

PATENT NO. : 6,481,024 B1
DATED : November 19, 2002
INVENTOR(S) : Stephen P. Grant It is certified that error appears in the above-identified patent and that said Letters Patent is hereby corrected as shown below:

Title page,
Item [57], ABSTRACT,
Line 1, add -- The invention disclosed and claimed in this patent is --;

Column 8,
Line 41, delete "surfacer 7" and replace with -- surface 17 --;
Line 46, after the word "but" delete "row".

Signed and Sealed this

Twenty-ninth Day of July, 2003

JAMES E. ROGAN
*Director of the United States Patent and Trademark Office*